US010384092B1

(12) United States Patent
Karapetian

(10) Patent No.: US 10,384,092 B1
(45) Date of Patent: Aug. 20, 2019

(54) ISOMETRIC EXERCISE DEVICE

(71) Applicant: Gregory Karapetian, Tarzana, CA (US)

(72) Inventor: Gregory Karapetian, Tarzana, CA (US)

( * ) Notice: Subject to any disclaimer, the term of this patent is extended or adjusted under 35 U.S.C. 154(b) by 10 days.

(21) Appl. No.: 15/588,655

(22) Filed: May 7, 2017

Related U.S. Application Data

(60) Provisional application No. 62/333,200, filed on May 7, 2016.

(51) Int. Cl.
*A63B 21/002* (2006.01)
*A63B 23/02* (2006.01)
*A63B 71/06* (2006.01)

(52) U.S. Cl.
CPC ..... *A63B 21/0023* (2013.01); *A63B 23/0205* (2013.01); *A63B 71/0622* (2013.01); *A63B 2071/0658* (2013.01); *A63B 2220/51* (2013.01); *A63B 2225/093* (2013.01)

(58) Field of Classification Search
CPC ..... A63B 21/002; A63B 23/02; A63B 71/06; A63B 2071/06; A63B 2220/05; A63B 2225/09
See application file for complete search history.

(56) References Cited

U.S. PATENT DOCUMENTS 7,121,982 B2 * 10/2006 Feldman ..... A63B 21/002 482/8
7,357,765 B1 * 4/2008 Watson ..... A63B 21/00072 482/142
7,699,755 B2 * 4/2010 Feldman ..... A63B 21/002 482/1
7,963,887 B2 * 6/2011 Ozawa ..... A63B 21/00181 434/247
8,388,499 B1 * 3/2013 Rindfleisch ..... A63B 22/0089 482/1
9,005,145 B2 * 4/2015 Champsaur ..... A63B 21/0058 482/4
9,011,301 B2 * 4/2015 Balandis ..... A63B 24/0087 482/115
9,095,492 B2 * 8/2015 Verkaaik ..... A61H 1/0274
2003/0028130 A1 * 2/2003 Wunderly ..... A61H 1/0274 601/5
2007/0066451 A1 * 3/2007 Gruben ..... A63B 24/00 482/92
2007/0232467 A1 * 10/2007 Puzey ..... A63B 21/0087 482/112
2007/0299371 A1 * 12/2007 Einav ..... G06F 19/00 601/5

* cited by examiner

*Primary Examiner* — Garrett K Atkinson

(57) ABSTRACT

The present disclosure provides an exercise apparatus and method of use therein, for improving the physical fitness and health of an individual by isometric exercise. Specifically, the present disclosure provides an exercise device utilizing the benefits of isometric exercise, specifically for the strengthening and/or exercising the core muscles of the body.

18 Claims, 4 Drawing Sheets

ISOMETRIC EXERCISE DEVICE

This Application claims the benefit of U.S. Provisional Patent Application No. 62/333,200, filed May 7, 2016, which is incorporated herein in its entirety.

TECHNICAL FIELD

The disclosure general relates to a physical fitness device and method, and specifically to an isometric exercise device for use on various muscles and/or muscle groups.

BACKGROUND ART

Several different modes of exercise have been incorporated in recent years in attempting to provide diversity and variety to end users. Examples of strength training modalities include: Isotonic, which provides resistance training with weights, machines, bands, and bodyweight as the resistance type; Isokinetic, wherein a machine is used that controls the speed of movement against which a muscle contracts and offers only concentric, or positive, movements (muscle shortening); as well as Isometric, where muscle is contracted against a force that is greater than a muscle's maximal force generating capacity thereby allowing no movement of the applied load.

The present disclosure concerns the Isometric mode of exercise, which was evolved in a laboratory setting, and in contrast to isotonic weight training. Although exercise apparatuses that provide resistive movement have been known for many years. These apparatus typically include elements that move relative to each other and provide a resistive force to further strengthen and exercise the muscles of a user. Typically, a user exerts muscular force against the resistive force provided by the apparatus to strengthen the user's muscles. These apparatuses exercise a wide variety of muscle groups of a user.

It is known that a beneficial method of exercising and strengthening the muscles of a user involve isometric contractions of the muscles. Isometric contractions are muscle contractions whereby the muscle tension is increased, but the muscle is not shortened because the resistance is not presently overcome. Isometric contraction is also known as static contraction. An isometric contraction also includes holding or pausing during an exercise movement thereby exerting constant force against the resistive force while not shortening or lengthening the muscle. Isometric training is an important part of many fitness routines. Isometric contractions are easily seen in activities such as wrestling, rock climbing and football blocking movements. Even more so, isometric exercises are a great way to isolate muscle groups and familiarize a user with how it feels to isolate and exercise a muscle. Hanging from a pull-up bar and performing wall sits are isometric exercises that fitness instructors have been using with athletes for years. Bodybuilding posing routines are a series of isometric contractions. Isometric exercises are also used for rehabilitation of muscle around damaged joints.

Despite the known positive effects of isometric exercise, there is little interest in isometric training by exercise enthusiasts, trainers and the general public. The less than desirable non-motive form of exercise have be coined "static" and "statuesque" and "poser", which has further deterred isometrics and it's adoption.

However, with the progression of the baby-boomer generation into senior-citizenship, the need for an effective exercise method that is less obtrusive and likely to cause injury is much needed and desired.

SUMMARY

The present disclosure provides an exercise apparatus and method of use therein, for improving the physical fitness and health of an individual by isometric exercise. Specifically, the present disclosure provides an exercise device utilizing the benefits of isometric exercise, specifically for the strengthening and/or exercising the core muscles of the body. The exercise device comprises a body wherein a base is attached about the distal end of the body and perpendicular to the length of the body. The base is configured for providing a foundation for the device, and further configured to rest between at least one leg of an end user and a seat, when the end user is seated. In other embodiments/use applications, the base may be configured to rest between at least one leg of an end user and a support, such as when the end user is seated on the ground or other support. The body is further attached to an arm configured about perpendicular to the body and about parallel to the base. The arm is situated about the proximal end of the body. The exercise device further comprises a sensor configured to measure force exerted on the device, as well as a graphic display in communication with the sensor to relay information regarding the amount of force exerted on the exercise device. The graphic display may be configured on the exercise device, or alternatively may utilize the graphic display found on an auxiliary device, such as a smart telephone, personal display apparatus, and common electrical apparatus.

In engaging a first group of core muscles, the end user configures the body between the legs near the pelvis, and adjacent to the torso, wherein the base of the exercise device rests between the thighs of the end user and the support surface (eg chair, ground, etc.). The end user further rests his/her arms on the arm of the exercise device. In one or more embodiments, the body, arm and/or base may be adjustable in height, length and/or girth to accommodate the desired position relative to the end user. The end user may engage his/her core abdominal muscles to compress the arm against the base, thus building muscle through isometric resistance.

In engaging a second group of core muscles, the end user configures the body between the legs near the pelvis, and adjacent to the torso, wherein the base of the exercise device rests between the thighs of the end user and the support surface (eg chair, ground, etc.). The end user further rests his/her arms below the arm of the exercise device. In one or more embodiments, the body, arm and/or base may be adjustable in height, length and/or girth to accommodate the desired position relative to the end user. The end user may engage his/her core back muscles to extend the arm against the base, thus building muscle through isometric resistance.

In both instances, the sensor is capable of reading, recording and relaying the amount of force exerted by the end user on the exercise device. The sensor may further communicate with pre-set or custom programmed exercise routines aimed at enhancing the exercise experience and targeting the end users desired goals and/or objectives.

BRIEF DESCRIPTION OF DRAWINGS

The accompanying drawings, which are incorporated in and constitute a part of the specification, illustrate exemplary embodiments of the present invention.

DETAILED DESCRIPTION

The following description of exemplary embodiment(s) is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate. For example, member formation and manufacturing may not be discussed in detail, however such processes as known by one of ordinary skill in the art and equivalent methods, processes, and materials would fall within the intended scope of exemplary embodiments. For example, materials, temperatures of formation, sizes of layers, and time increments for steps may be discussed, however other materials, times, temperatures, and sizes are meant to lie within the scope of exemplary embodiments.

Figure 1:
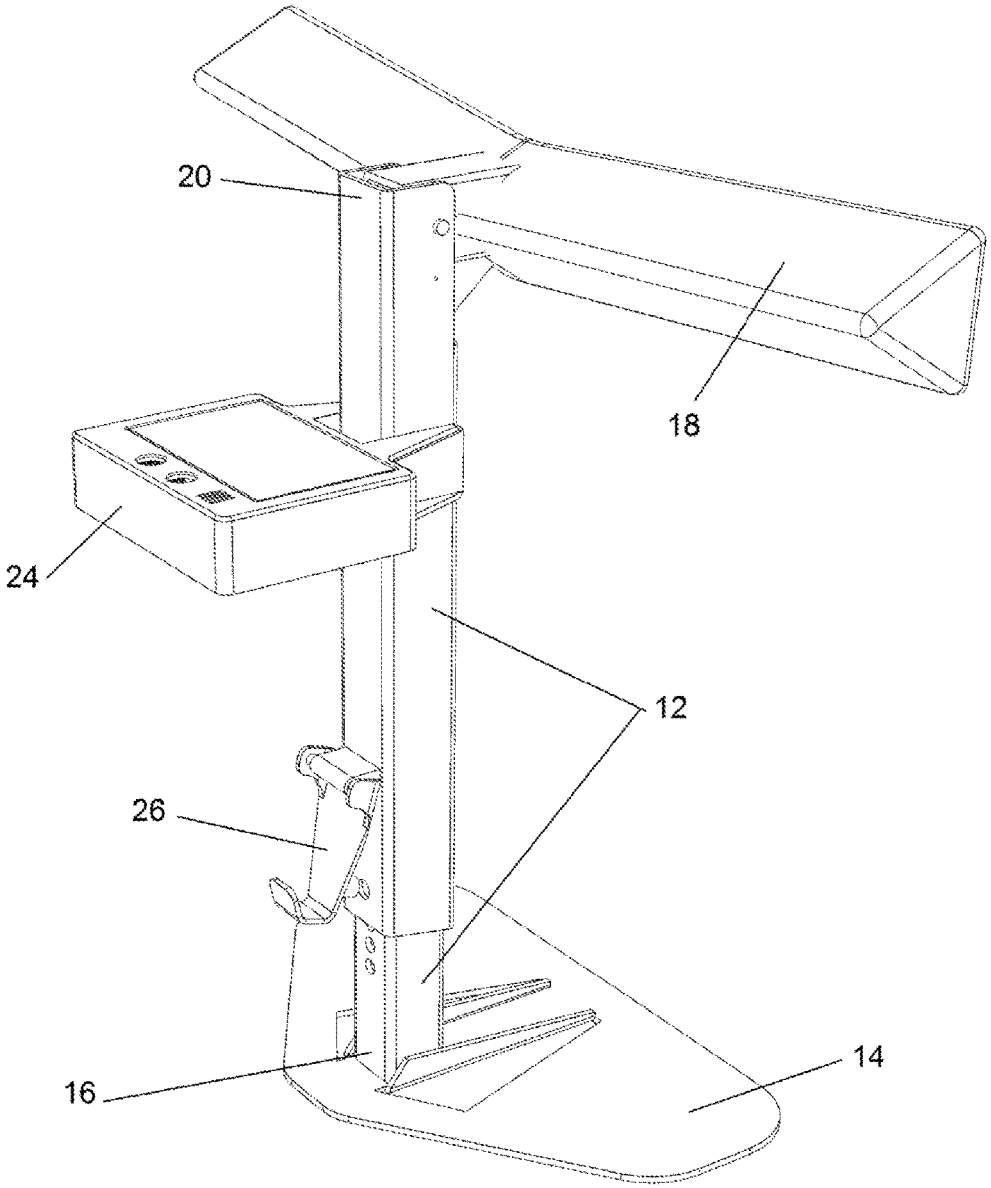
FIG. 1 provides a front perspective view of the exercise apparatus according to one or more embodiment of the subject disclosure.

FIG. 1 provides a front perspective view of the exercise apparatus according to one or more embodiment of the subject disclosure. In FIG. 1, the exercise device 10 incorporates a body 12, which acts as the frame of the device 10. Although the enclosed Fig.'s depict a two-piece body, allowing for adjustability in the body 12, it is within the realm of the subject disclosure to have a one-piece body 12 having no adjustment. The body 12 is attached to a base 14 which is configured about the distal end 16 of the body 12, about perpendicular to the length of the body 12. The base 14 is configured to rest between at least one leg of an end user and a seat, when the end user is seated. In other embodiments/use applications, the base may be configured to rest between at least one leg of an end user and a support, such as when the end user is seated on the ground or other support. The body 12 is further attached to an arm 18 configured about perpendicular to the body 12 and about parallel to the base 14. The arm 18 is situated about the proximal end 20 of the body 12. The arm 18 is configured to allow an end user to rest his/her arms on top of the arms 18, so as to press down on the arm 18, engaging abdominal and torso muscles. In addition, the arm 18 is configured to allow an end user to engage the arm 18 with the end user's arms under the arm 18, so as to pull up on the arm 18, engaging back and torso muscles. The exercise device 10 further comprises a sensor 22 configured to measure force exerted on the device 10, as well as a graphic display 24 in communication with the sensor 22 to relay information regarding the amount of force exerted on the exercise device 22. The sensor 22 may be configured within the body 12 of the device 10, or on the arm 18 or base 14. In various embodiments, multiple sensors may be incorporated for additional sensing and recording of force exerted upon the exercise device 10. The graphic display 24 may be configured on the exercise device 10, or alternatively may utilize the graphic display found on an auxiliary device, such as a smart telephone, pda, and common electrical apparatus. The graphic display 24 may include a screen 34, speakers 36 and/or controls 38 (see FIG. 4) for manipulating the graphic display 24.

Figure 2:
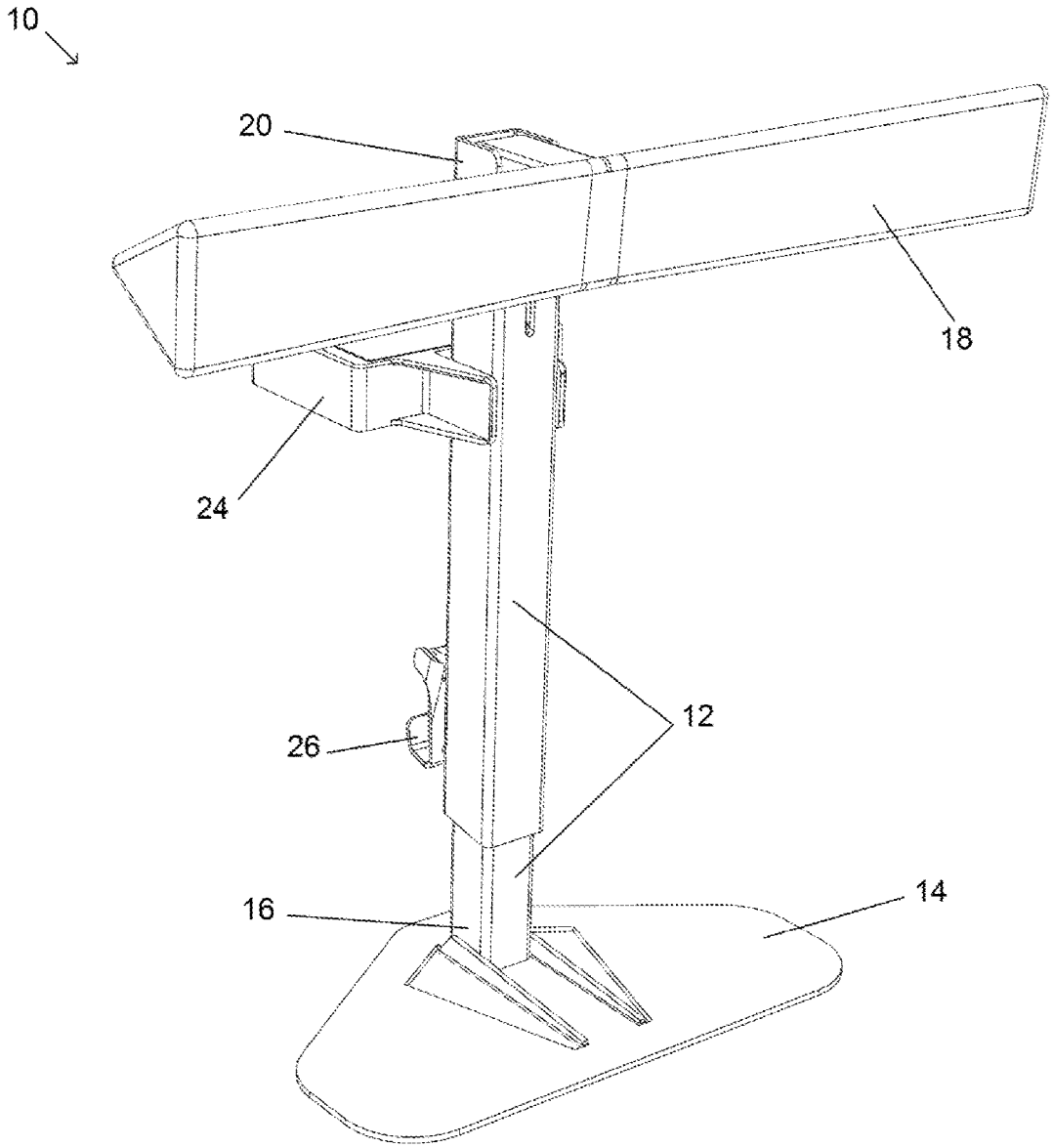
FIG. 2 provides a rear perspective view of the exercise apparatus according to one or more embodiment of the subject disclosure.

FIG. 2 provides a rear perspective view of the exercise apparatus according to one or more embodiment of the subject disclosure. As seen in FIG. 1, the exercise device 10 comprises a two-piece body 12, which is configured for adjustability to conform to the torso size of various end users. Typical adjustment of the two-piece body 12 is accomplished by a pin and sleeve mechanism, however various other means may used, including, but not limited to, a ratchet system, compression clamp, pawl and wheel, and others. As mentioned previously, it is within the scope of the subject disclosure to have a one-piece body 12 without adjustment. The body 12 is attached to a base 14 that is situated at the distal end 16 of the body 12, and is approximately perpendicular to the length of the body 12. The base 14 is designed to support the device 10, and is further configured to rest between at least one leg of an end user and a seat. In other embodiments/use applications, the base may be configured to rest between at least one leg of an end user and a support, such as when the end user is seated on the ground or other support. The body 12 is also attached to an arm 18 found approximately perpendicular to the body 12. The arm 18 is configured at the proximal end 20 of the body 12, so as to resemble a "T". The arm 18 is configured to allow an end user to rest his/her arms on top of the arms 18, so as to press down on the arm 18, engaging abdominal and torso muscles. In addition, the arm 18 is configured to allow an end user to engage the arm 18 with the end user's arms under the arm 18, so as to pull up on the arm 18, engaging back and torso muscles.

Figure 3:
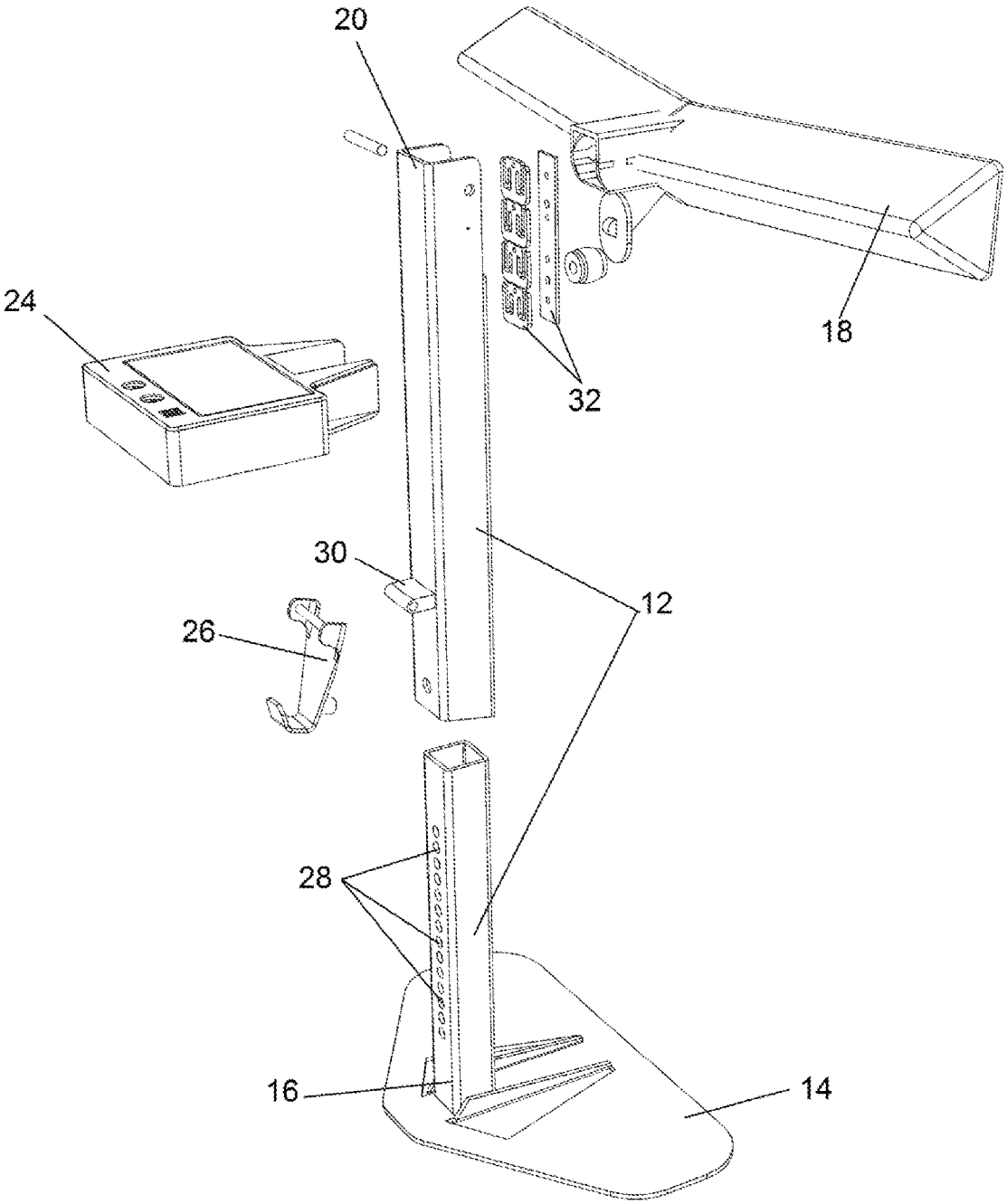
FIG. 3 provides an exploded perspective view of the exercise apparatus according to one or more embodiment of the subject disclosure.

FIG. 3 provides an exploded perspective view of the exercise apparatus according to one or more embodiment of the subject disclosure. Most of the components in FIG. 3 have been described in the previous Figures (FIG. 1 and FIG. 2). However, FIG. 3 provides an exploded view which further depicts additional components of the device 10, including details of the adjustment device comprising of the lever 26 having a pin, pivot joint 30, as well as multiple holes 28 for receiving the pin, and affixing the body 12 in a desired position and height. FIG. 3 further depicts an arm adjustment 32.

Figure 4:
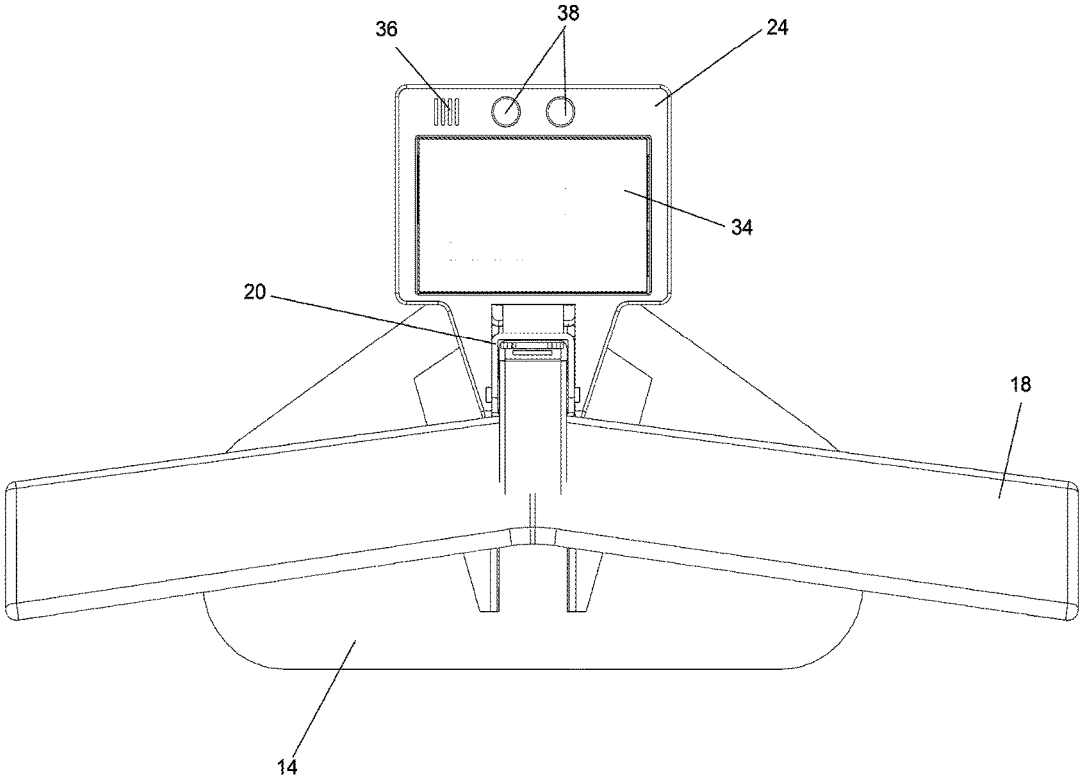
FIG. 4 provides a top perspective view of the exercise apparatus according to one or more embodiment of the subject disclosure.

FIG. 4 provides a top perspective view of the exercise apparatus according to one or more embodiment of the subject disclosure. Specifically, FIG. 4 depict details of the graphic display 24, which may include a screen 34, speaker/microphone 36, as well as input controls 38.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

The invention claimed is:

1. An apparatus for isometric exercise resting on a support comprising:

a body configured perpendicular to the support:

a base attached to the body and configured in a plane perpendicular to a length of the body;

a T-shaped arm attached to the body and configured perpendicular to the body and parallel with the base;

a sensor in communication with the apparatus and configured to measure force exerted upon the arm with respect to the body; and a graphic display in communication with the sensor, wherein the base is configured to be resting upon the support and confined between at least one leg of an end user and the support, when the end user is seated upon the support, wherein the body is substantially rigid, and wherein the arm is configured to allow the end user to rest the user's arms on top of the arm and press down on the arm to perform a first isometric exercise, the arm further configured to allow the end user to engage the arm with the end user's arms under the arm to pull up on the arm to perform a second isometric exercise, the body remaining substantially rigid during the first and second exercises.

2. The apparatus of claim 1, wherein the base is configured to be attached to a distal end of the body.

3. The apparatus of claim 1, wherein the arm is configured to be attached to a proximal end of the body.

4. The apparatus of claim 1, wherein the arm is adjustable parallel to the length of the body with respect to the base.

5. The apparatus of claim 1, wherein the base is configured to rest between a surface and at least one leg on an end user.

6. The apparatus of claim 1, wherein the arm is situated to allow for both compression and extension by an end user in a plane parallel to the length of the body.

7. The apparatus of claim 1, wherein the graphical display is situated on the apparatus.

8. The apparatus of claim 1, wherein the graphical display is in virtual connection to the apparatus, allowing for display on a portable device.

9. The apparatus of claim 8, wherein the portable device may be selected from the group consisting of a cellular phone, smart device, personal display apparatus or watch.

10. A method of isometric exercise, comprising:

providing the apparatus of claim 1, configuring the apparatus between the support and the at least one leg of the end user;

compressing the apparatus for a length of time; and extending the apparatus for a length of time.

11. The method of claim 10, wherein the base is configured to be attached to a distal end of the body.

12. The method of claim 10, wherein the arm is configured to be attached to a proximal end of the body.

13. The method of claim 10, wherein the arm is adjustable parallel to the length of the body with respect to the base.

14. The method of claim 10, wherein the base is configured to rest between a surface and at least one leg on an end user.

15. The method of claim 10, wherein the arm is situated to allow for both compression and extension by an end user in a plane parallel to the length of the body.

16. The method of claim 10, wherein the graphical display is situated on the apparatus.

17. The method of claim 10, wherein the graphical display is in virtual connection to the apparatus, allowing for display on a portable device.

18. The method of claim 17, wherein the portable device may be selected from the group consisting of a cellular phone, smart device, personal display apparatus or watch.

* * * * *